US011756569B2

(12) United States Patent
Wang et al.

(10) Patent No.: US 11,756,569 B2
(45) Date of Patent: Sep. 12, 2023

(54) SOUND QUALITY EVALUATION METHOD AND SOUND QUALITY EVALUATION SYSTEM USING SAME

(71) Applicant: ASUSTeK COMPUTER INC., Taipei (TW)

(72) Inventors: Chun-Chi Wang, Taipei (TW); Kuo-Yuan Huang, Taipei (TW); Wei-Chen Kuan, Taipei (TW); Tzu-Yin Su, Taipei (TW); Tsung-Yen Yu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/829,810

(22) Filed: Jun. 1, 2022

(65) Prior Publication Data

US 2023/0053206 A1 Feb. 16, 2023

(30) Foreign Application Priority Data

Aug. 12, 2021 (TW) ..... 110129852

(51) Int. Cl.
*G10L 25/51* (2013.01)

(52) U.S. Cl.
CPC ..... *G10L 25/51* (2013.01)

(58) Field of Classification Search
None
See application file for complete search history.

(56) References Cited

U.S. PATENT DOCUMENTS

2021/0306780 A1* 9/2021 Schobert ..... G01R 31/2872
2021/0306782 A1* 9/2021 Klinke ..... H04R 29/005
2022/0036878 A1* 2/2022 Cyr ..... G10L 25/48

FOREIGN PATENT DOCUMENTS

CN 111985788 A 11/2020
CN 112215469 A 1/2021

* cited by examiner

*Primary Examiner* — Paul W Huber
(74) *Attorney, Agent, or Firm* — McClure, Qualey & Rodack, LLP

(57) ABSTRACT

A sound quality evaluation method and a sound quality evaluation system using same are provided. The sound quality evaluation system records playback of a test audio file on a plurality of playback devices to generate a plurality of pieces of audio data, and divides the audio data into a plurality of frequency bands. The sound quality evaluation system calculates the frequency bands to obtain a plurality of evaluation scores of the playback devices. The sound quality evaluation system captures sound quality ranking information corresponding to the playback devices from a reference source, and adjusts the evaluation scores according to the sound quality ranking information, to further obtain a reference model. The sound quality evaluation system adjusts correspondingly evaluation scores of a plurality of to-be-tested playback devices according to the reference model, to obtain sound quality ranking information of the to-be-tested playback devices.

8 Claims, 3 Drawing Sheets

SOUND QUALITY EVALUATION METHOD AND SOUND QUALITY EVALUATION SYSTEM USING SAME

CROSS-REFERENCE TO RELATED APPLICATION

This application claims the priority benefit of Taiwan Application Serial No. 110129852, filed on Aug. 12, 2021. The entirety of the above-mentioned patent application is hereby incorporated by reference herein and made a part of the specification.

BACKGROUND OF THE INVENTION

Field of the Invention

The disclosure relates to a method and a system for evaluating sound quality of a playback device.

Description of the Related Art

When purchasing playback devices, consumers usually listen to audio files played by the playback devices to determine their preferred products. Most product analyses on the Internet focus on analyzing playback devices according to subjective feelings of analysts. That is to say, there is currently no objective and accurate evaluation method on the market to analyze performance of playback devices. In addition, affected by subjective feelings, people evaluate the same product differently. Such a status makes it difficult for consumers to select suitable products from subjective playback device rankings.

BRIEF SUMMARY OF THE INVENTION

The disclosure discloses a sound quality evaluation method for providing sound quality ranking information of a plurality of playback devices, including the following steps: defining the playback devices as a first group and a second group, and recording respectively playback of at least one test audio file on the first group and the second group, to generate a plurality of pieces of first audio data and a plurality of pieces of second audio data; dividing respectively each piece of first audio data and each piece of second audio data, to generate a plurality of first group frequency bands and a plurality of second group frequency bands; calculating and processing respectively the first group frequency bands and the second group frequency bands, to obtain a plurality of first evaluation scores of the first group and a plurality of second evaluation scores of the second group; capturing first sound quality ranking information corresponding to the first group from a reference source; referring to the first sound quality ranking information to adjust correspondingly the first evaluation scores, to further obtain a first reference model; and adjusting correspondingly the second evaluation scores according to the first reference model, to further obtain second sound quality ranking information of the second group.

The disclosure also discloses a sound quality evaluation system, including an audio recording module, a calculation module, a communication module, and a processing module. The audio recording module is configured to define a plurality of playback devices as a first group and a second group, and record respectively playback of at least one test audio file on the first group and the second group, to generate a plurality of pieces of first audio data and a plurality of pieces of second audio data.

The calculation module is configured to divide each piece of first audio data and each piece of second audio data, to generate a plurality of first group frequency bands and a plurality of second group frequency bands, and calculate and process respectively the first group frequency bands and the second group frequency bands, to obtain a plurality of first evaluation scores of the first group and a plurality of second evaluation scores of the second group.

The communication module is configured to capture first sound quality ranking information corresponding to the first group from a reference source. The processing module is configured to refer to the first sound quality ranking information to adjust correspondingly the first evaluation scores, to further obtain a first reference model, and adjust correspondingly the second evaluation scores according to the first reference model, to further obtain second sound quality ranking information of the second group.

The sound quality evaluation method and the sound quality evaluation system of the disclosure trains, by referring to sound quality ranking information of audio devices released by one or more public Internet databases, a sound quality evaluation algorithm model that objectively evaluates sound quality of the audio devices without requiring an acoustic expert to intervene in the training process.

With the accumulation of training data, evaluation scores calculated by a sound quality evaluation model of the disclosure not only approach the judgment of an acoustic expert, but also entirely avoid an evaluation result deviation occasionally caused by changes of physical and psychological conditions of the acoustic expert during evaluation. Therefore, the sound quality evaluation model evaluates sound quality of various playback devices more objectively and consistently than the acoustic expert. Therefore, an objective and accurate evaluation method is provided, to make it convenient for a user to learn of performance of the playback devices.

DETAILED DESCRIPTION OF THE EMBODIMENTS

Some embodiments of the disclosure will be disclosed below with drawings. For clear description, many practical details will be described in the following descriptions, but do not limit the patent scope of the disclosure.

Figure 1:
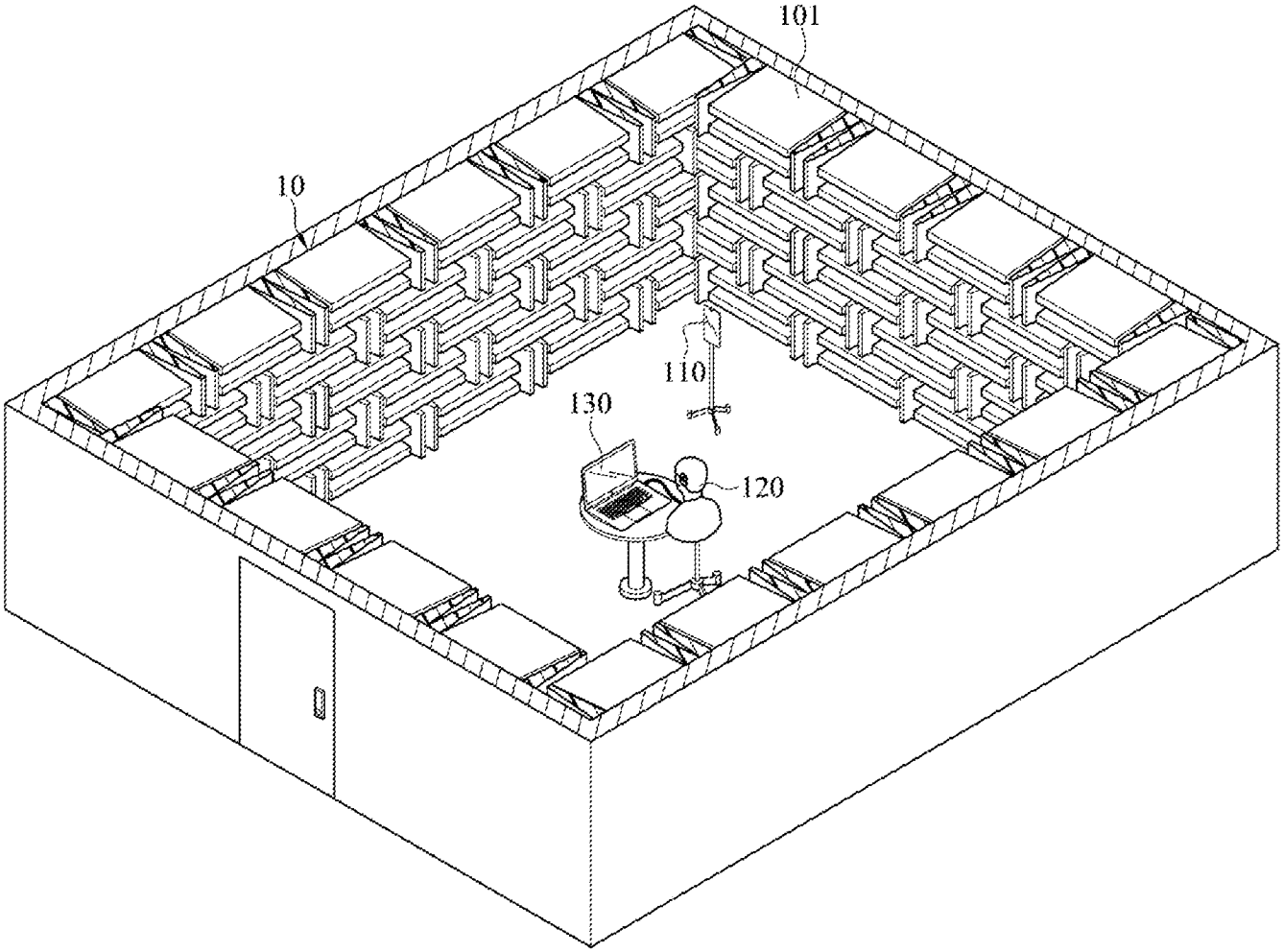
FIG. 1 is a schematic diagram of an implementation environment of a sound quality evaluation method according to an embodiment of the disclosure.

As shown in FIG. 1, in some embodiments, an implementation environment of a sound quality evaluation method is a listening room 10. The listening room 10 is a space defined by the European Telecommunications Standards Institute (ETSI) and the International Electrotechnical Commission (IEC) for appreciating electroacoustic products and speakers. The listening room 10 includes a to-be-tested playback device 110, an artificial head device 120, and a computer host 130. The computer host 130 is disposed beside the artificial head device 120, and the computer host 130 is electrically connected to the artificial head device 120.

Figure 2:
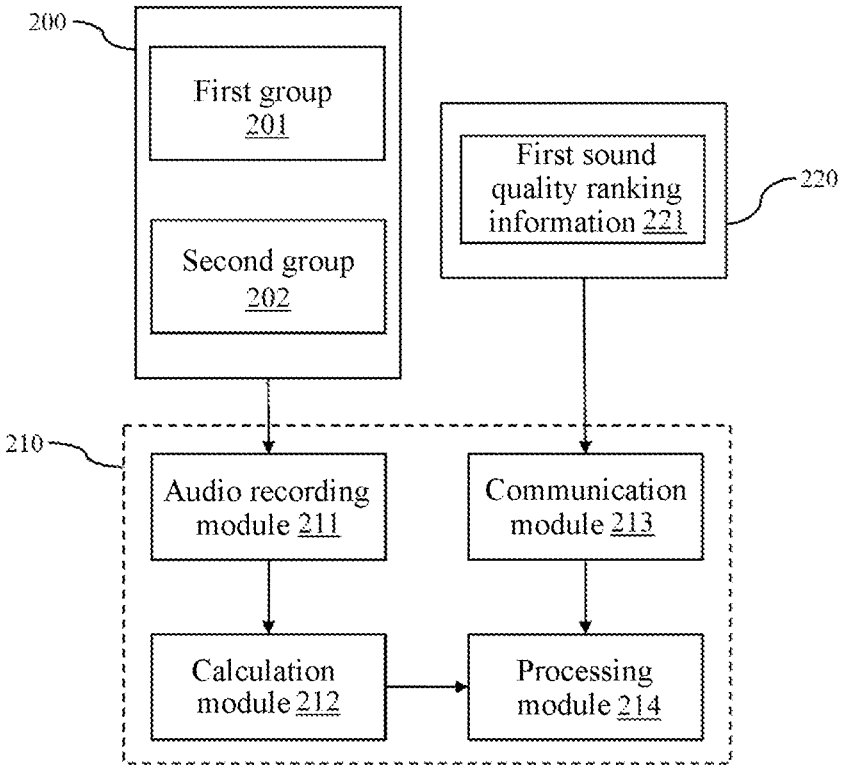
FIG. 2 is a schematic diagram of a sound quality evaluation system performing a sound quality evaluation method according to an embodiment of the disclosure.
Figure 3:
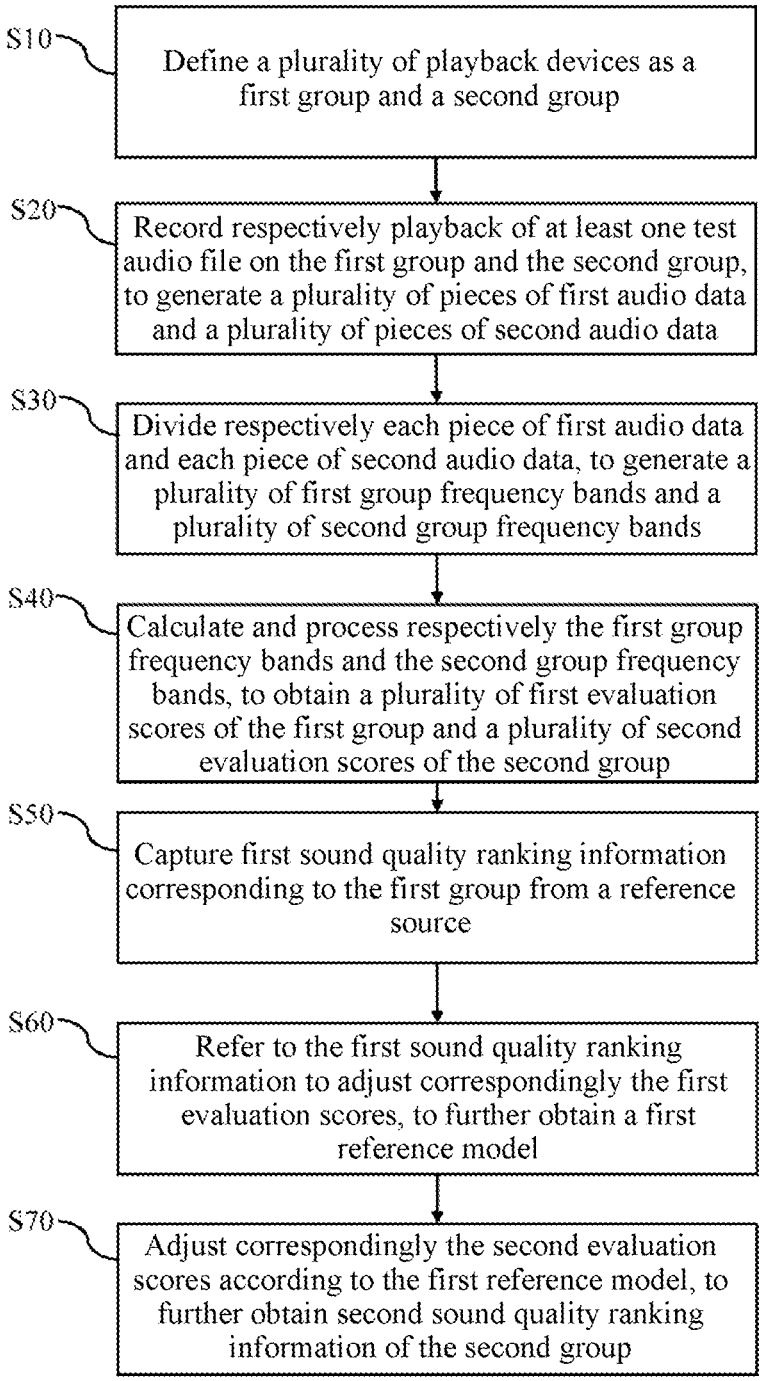
FIG. 3 is an example flowchart of a sound quality evaluation method according to the disclosure.

FIG. 2 is a schematic diagram of a sound quality evaluation system 210 performing a sound quality evaluation method according to an embodiment of the disclosure, and FIG. 3 is an example flowchart of a sound quality evaluation method according to the disclosure. The sound quality evaluation system 210 is used to perform the sound quality evaluation method, and includes an audio recording module 211, a calculation module 212, a communication module 213, and a processing module 214. The audio recording module 211 is electrically connected to the calculation module 212, the calculation module 212 is electrically connected to the processing module 214, and the processing module 214 is electrically connected to the communication module 213.

As shown in FIG. 3, after a plurality of playback devices 200 is defined as a first group 201 and a second group 202 (step S10), and the audio recording module 211 of the sound quality evaluation system 210 records respectively playback of at least one test audio file on playback devices of the first group 201 and playback devices of the second group 202, to generate a plurality of pieces of first audio data and a plurality of pieces of second audio data (step S20).

In an embodiment, the sound quality evaluation system 210 is a mobile phone, a tablet computer, or a personal computer.

In an embodiment, the audio recording module 211 is the artificial head device 120. The artificial head device 120 is a microphone that simulates a structure of a human ear, and is used to receive audio data by simulating a human ear to analyze impact of structures of parts of the human body on an auditory sense of the human ear.

In an embodiment, the playback device 200 is any model of speaker, stereo, mobile phone, tablet computer, or personal computer.

In an embodiment, the test audio file is an audio file in any audio file format such as an MP3 file, a WAV file, an AAC file, or a FLAC file. The audio recording module 211 records the test audio file into audio data in a fixed audio format.

The calculation module 212 of the sound quality evaluation system 210 divides respectively each piece of first audio data and each piece of second audio data, to generate a plurality of first group frequency bands and a plurality of second group frequency bands (step S30). Frequencies of the frequency bands fall within a range of 100 Hz to 22 KHz, and the range of 100 Hz to 22 KHz is a frequency range of sounds that are audible to ordinary people. Dividing each audio data into a plurality of frequency bands is used to capture sound frequencies that are audible to human ears, and filter out sound frequencies that are inaudible to human ears.

In an embodiment, the calculation module 212 is a central processing unit (CPU), a graphics processing unit (GPU), or a computing unit with a computing function.

In an embodiment, the calculation module 212 divides each piece of first audio data and each piece of second audio data into a plurality of frequency bands, in an embodiment, but not limited to, 26 frequency bands.

After dividing each piece of first audio data and each piece of second audio data into the plurality of first group frequency bands and the plurality of second group frequency bands, the calculation module 212 continues to calculate and process respectively the first group frequency bands and the second group frequency bands, to obtain a plurality of first evaluation scores of the first group 201 and a plurality of second evaluation scores of the second group 202 (step S40).

The calculation module 212 calculates, by a machine learning algorithm and a sound quality evaluation algorithm model, the first group frequency bands and the second group frequency bands, to obtain the first evaluation scores and the second evaluation scores. The first evaluation scores are sound quality performance of the playback devices of the first group 201, the second evaluation scores are sound quality performance of the playback devices of the second group 202, and a higher evaluation score indicates better sound quality performance of a playback device.

In an embodiment, the machine learning algorithm is a gradient descent method. A formula of the gradient descent method is $\hat{x}(t+1)=\hat{x}t-\gamma\times\Delta f(\hat{x}t)$. f(x) is a sound quality evaluation function (that is, a sound quality evaluation algorithm model), x is an energy of each frequency band of the first audio data, γ is a learning rate, Δf is a target score, and t is the number of updates. An initial model of the sound quality evaluation algorithm model is a random initial reference model. The initial reference model is well-known to a person of ordinary skill in the art, and details are not described herein again.

The learning rate refers to an update range in each update, and a value of the learning rate needs to be gradually adjusted in the updating process. In this embodiment, the value of the learning rate falls within a range of 0.001 to 0.002, and an adjustment range of the value of the learning rate falls within a range of 0.00001 to 0.0001.

The communication module 213 of the sound quality evaluation system 210 captures first sound quality ranking information 221 corresponding to the playback devices of the first group 201 from a reference source 220 (step S50). The communication module 213 is connected to the reference source 220 through a wired network or a wireless network.

In an embodiment, the reference source 220 is a public Internet database. The public Internet database includes sound quality ranking information of a plurality of playback devices 200 of a plurality of models. In an embodiment, the communication module 213 of the sound quality evaluation system 210 captures sound quality ranking information of a plurality of playback devices 200 of a plurality of models from a mobile phone evaluation website.

After the first sound quality ranking information 221 is captured, the processing module 214 of the sound quality evaluation system 210 refers to the first sound quality ranking information 221 to adjust correspondingly the first evaluation scores, to further obtain a first reference model (step S60).

The processing module 214 adjusts a parameter of the initial reference model to a first parameter to obtain the first reference model, so that an order of the first evaluation scores is matched with the first sound quality ranking information 221 after being calculated by the machine learning algorithm and the first reference model, that is to say, the order of the first evaluation scores is the same as a ranking order of the playback devices of the first group 201 in the first sound quality ranking information 221.

In an embodiment, the processing module 214 is a central processing unit (CPU), a graphics processing unit (GPU), or a computing unit with a computing function.

The processing module 214 of the sound quality evaluation system 210 adjusts correspondingly the second evaluation scores according to the first reference model, to further obtain second sound quality ranking information of the second group 202 (step S70). At this time, the sound quality evaluation algorithm model f(x) has been trained, and objectively evaluates sound quality performance of one or more playback devices 200. Therefore, after the second audio data is calculated by the machine learning algorithm and the first reference model, objective second sound quality ranking information and sound quality performance of the playback devices of the second group 202 are obtained.

In an embodiment, the calculation module 212 of the sound quality evaluation system 210 further calculates the second audio data by using a spatiality algorithm, to obtain a plurality of spatiality scores of the second group 202. A higher spatiality score indicates better spatiality performance of a playback device of the second group 202 during audio playback. The spatiality algorithm includes a head-related transfer function and a minimum variance distortionless response algorithm. The head-related transfer function and the minimum variance distortionless response algorithm are well-known to a person of ordinary skill in the art, and details are not described herein again.

In an embodiment, the calculation module 212 of the sound quality evaluation system 210 further calculates the second audio data by using a dynamicity algorithm, to obtain a plurality of dynamicity scores of the second group 202. A higher dynamicity score indicates better dynamicity performance of a playback device of the second group 202 during audio playback. The dynamicity algorithm includes a spectrum analysis method, a linear regression method, and a Gini coefficient method. The spectrum analysis method, the linear regression method, and the Gini coefficient method are well-known to a person of ordinary skill in the art, and details are not described herein again.

In an embodiment, the calculation module 212 of the sound quality evaluation system 210 further calculates the second audio data by using a volume algorithm, to obtain a plurality of volume scores of the second group 202. A higher volume score indicates better volume performance of a playback device of the second group 202 during audio playback. The volume algorithm is a dynamic range suppression method. The dynamic range suppression method is well-known to a person of ordinary skill in the art, and details are not described herein again.

In an embodiment, the calculation module 212 of the sound quality evaluation system 210 further calculates the second audio data by using a distortion algorithm, to obtain a plurality of distortion scores of the second group 202. A higher distortion score indicates poorer distortion performance of a playback device of the second group 202 during audio playback. The distortion algorithm includes a dynamic intermodulation distortion method and a sharpness spectrum analysis method (also referred to as a sibilance spectrum analysis method). The dynamic intermodulation distortion method and the sibilance spectrum analysis method is well-known to a person of ordinary skill in the art, and details are not described herein again.

The sound quality evaluation method and the sound quality evaluation system of the disclosure trains, by referring to sound quality ranking information of audio devices released by one or more public Internet databases, a sound quality evaluation algorithm model that objectively evaluates sound quality of the audio devices without requiring an acoustic expert to intervene in the training process. With the accumulation of training data, evaluation scores calculated by a sound quality evaluation model of the disclosure not only approach the judgment of an acoustic expert, but also entirely avoid an evaluation result deviation occasionally caused by changes of physical and psychological conditions of the acoustic expert during evaluation. Therefore, the sound quality evaluation model evaluates sound quality of various playback devices more objectively and consistently than the acoustic expert. Therefore, an objective and accurate evaluation method is provided, to make it convenient for a user to learn of performance of the playback devices.

Although the disclosure is described above with embodiments, the embodiments are not intended to limit the disclosure. Any person of ordinary skill in the art may make modifications and changes without departing from the spirit and scope of the contents of the present disclosure. The modifications and changes should be subject to the patent scope of the disclosure.

What is claimed is:

1. A sound quality evaluation method for providing sound quality ranking information of a plurality of playback devices, comprising:

defining the playback devices as a first group and a second group;

recording respectively playback of at least one test audio file on the first group and the second group, to generate a plurality of pieces of first audio data and a plurality of pieces of second audio data;

dividing respectively each piece of first audio data and each piece of second audio data, to generate a plurality of first group frequency bands and a plurality of second group frequency bands;

calculating and processing respectively the first group frequency bands and the second group frequency bands, to obtain a plurality of first evaluation scores of the first group and a plurality of second evaluation scores of the second group;

capturing first sound quality ranking information corresponding to the first group from a reference source;

referring to the first sound quality ranking information to adjust correspondingly the first evaluation scores, to further obtain a first reference model; and adjusting correspondingly the second evaluation scores according to the first reference model, to further obtain second sound quality ranking information of the second group.

2. The sound quality evaluation method according to claim 1, further comprising:

calculating the second audio data by using a spatiality algorithm, to obtain a plurality of spatiality scores of the second group;

calculating the second audio data by using a dynamicity algorithm, to obtain a plurality of dynamicity scores of the second group;

calculating the second audio data by using a volume algorithm, to obtain a plurality of volume scores of the second group; and calculating the second audio data by using a distortion algorithm, to obtain a plurality of distortion scores of the second group.

3. The sound quality evaluation method according to claim 1, wherein an artificial head device records playback of the at least one test audio file on the first group and the second group, to generate the pieces of first audio data and the pieces of second audio data.

4. The sound quality evaluation method according to claim 1, wherein the reference source is a public Internet database.

5. A sound quality evaluation system, comprising:

an audio recording module, configured to define a plurality of playback devices as a first group and a second group, and record respectively playback of at least one test audio file on the first group and the second group, to generate a plurality of pieces of first audio data and a plurality of pieces of second audio data;

a calculation module, configured to divide respectively each piece of first audio data and each piece of second audio data, to generate a plurality of first group frequency bands and a plurality of second group frequency bands, and calculate and process respectively the first group frequency bands and the second group frequency bands, to obtain a plurality of first evaluation scores of the first group and a plurality of second evaluation scores of the second group;

a communication module, configured to capture first sound quality ranking information corresponding to the first group from a reference source; and a processing module, configured to refer to the first sound quality ranking information to adjust correspondingly the first evaluation scores, to further obtain a first reference model, and adjust correspondingly the second evaluation scores according to the first reference model, to further obtain second sound quality ranking information of the second group.

6. The sound quality evaluation system according to claim 5, wherein the calculation module is further configured to calculate the second audio data by using a spatiality algorithm, to obtain a plurality of spatiality scores of the second group; calculate the second audio data by using a dynamicity algorithm, to obtain a plurality of dynamicity scores of the second group; calculate the second audio data by using a volume algorithm, to obtain a plurality of volume scores of the second group; and calculate the second audio data by using a distortion algorithm, to obtain a plurality of distortion scores of the second group.

7. The sound quality evaluation system according to claim 5, wherein the audio recording module is an artificial head device.

8. The sound quality evaluation system according to claim 5, wherein the reference source is a public Internet database.

* * * * *